US007701127B2

(12) United States Patent
Song et al.

(10) Patent No.: US 7,701,127 B2
(45) Date of Patent: Apr. 20, 2010

(54) FIELD EMISSION BACKLIGHT UNIT

(75) Inventors: Byong-Gwon Song, Seoul (KR); Deuk-Seok Chung, Seongnam-si (KR); Ho-Suk Kang, Seoul (KR); Kyoung-Won Min, Icheon-si (KR); Moon-Jin Shin, Yongin-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 708 days.

(21) Appl. No.: 11/485,275

(22) Filed: Jul. 13, 2006

(65) Prior Publication Data

US 2007/0035231 A1 Feb. 15, 2007

(30) Foreign Application Priority Data

Aug. 10, 2005 (KR) ..... 10-2005-0073274

(51) Int. Cl.
*H01J 1/62* (2006.01)

(52) U.S. Cl. ..... 313/496

(58) Field of Classification Search ..... 313/495–497, 313/309

See application file for complete search history.

(56) References Cited

U.S. PATENT DOCUMENTS 3,663,214 A * 5/1972 Moore et al. ..... 420/15
5,883,467 A * 3/1999 Chalamala et al. ..... 313/553
2002/0094494 A1* 7/2002 Chung et al. ..... 430/311
2003/0094892 A1* 5/2003 Moradi et al. ..... 313/495
2005/0152155 A1* 7/2005 Kang et al. ..... 362/558
2007/0018565 A1* 1/2007 Cho et al. ..... 313/497

FOREIGN PATENT DOCUMENTS

KR 10-2005-0072945 7/2005

OTHER PUBLICATIONS

Korean Office Action for corresponding Korean Patent Application No. 2005-0073274, issued on Nov. 10, 2006.

* cited by examiner

*Primary Examiner*—Toan Ton
*Assistant Examiner*—Hana A Sanei
(74) *Attorney, Agent, or Firm*—Robert E. Bushnell, Esq.

(57) ABSTRACT

A field emission backlight unit includes: upper substrate and lower substrate separated from each other and facing each other; an anode formed on a bottom surface of the upper substrate; a phosphor layer formed on a bottom surface of the anode; a plurality of cathodes and gate electrodes alternately formed on a top surface of the lower substrate; and emitters formed on the cathodes; the gate electrodes include first gate electrodes formed of a conductive material on the top surface of the lower substrate and second gate electrodes having a greater thickness than that of the first gate electrodes and formed on a top surface of the first gate electrodes.

35 Claims, 3 Drawing Sheets

FIELD EMISSION BACKLIGHT UNIT

CLAIM OF PRIORITY

This application makes reference to, incorporates the same herein, and claims all benefits accruing under 35 U.S.C. §119 from an application for FIELD EMISSION TYPE BACKLIGHT UNIT earlier filed in the Korean Intellectual Property Office on the of Aug. 10, 2005 and there duly assigned Serial No. 10-2005-0073274.

BACKGROUND OF THE INVENTION

1. Field of the Invention

The present invention relates to a field emission backlight unit, and more particularly, to a field emission backlight unit having improved luminous efficiency.

2. Description of the Related Art

In general, flat panel displays can be classified into light emitting displays and light receiving displays. Light emitting type displays include Cathode Ray Tubes (CRTs), Plasma Display Panels (PDPs), and Field Emission Displays (FEDs). Light receiving displays include Liquid Crystal Displays (LCDs). LCDs are light-weight and have low power consumption. However, the LCDs are light receiving displays that are not self-luminescent but form an image using incident light from the outside, and thus cannot provide an image in dark places. To solve this problem, backlight units are installed on a rear side of the LCD.

In conventional backlight units, a Cold Cathode Fluorescent Lamp (CCFL) has been used as a linear light source, and a Light Emitting Diode (LED) has been used as a point light source. However, the backlight units generally have a complicated structure, high manufacturing costs, and high power consumption due to reflection and transmission of light. In particular, as the size of the LCD increases, the uniformity of brightness cannot be easily obtained.

As such, in order to solve the problem, field emission backlight units having a flat light emission structure have been exploited. The field emission backlight units have a lower power consumption than conventional backlight units using CCFLs and provide comparatively uniform brightness even in a wider emission region. The field emission backlight units can also be used for illumination.

In a field emission backlight unit, an upper substrate and a lower substrate are separated from each other and face each other. An anode is formed on a bottom surface of the upper substrate, and a phosphor layer is formed on a bottom surface of the anode. A plurality of cathodes and a plurality of gate electrodes which are arranged in parallel to one another are formed on a top surface of the lower substrate. The cathodes and the gate electrodes are alternately formed on the same plane. The cathodes and the gate electrodes are formed of a thin film having a thickness of about 1000-3000 Å. A plurality of emitters formed of an electron emission material, for example, carbon nanotubes (CNTs), are disposed at both edges of the cathodes. A plurality of spacers for maintaining a uniform spacing between the upper substrate and the lower substrate are disposed therebetween. In the above structure, as voltages are supplied between the cathodes and the gate electrodes, electrons are emitted from the emitters disposed on the cathodes, and the emitted electrons are accelerated by the voltage supplied to the anode and excite the phosphor layer so that visible light is emitted.

However, in such a field emission backlight unit, since the cathodes and the gate electrodes are formed of a thin film on the same plane, an electric field formed around the emitters formed on the cathodes is greatly affected by the voltages supplied to the anode as well as the voltages supplied to the gate electrodes. Thus, in order to maximize the luminous efficiency of the phosphor layer, if a high voltage is supplied to the anode, the electric field formed around the emitters is affected by the voltage supplied to the anode so that excessive electrons are emitted from the emitters. As such, the current that flows through the anode increases. This results in degradation of the luminous efficiency of the backlight unit.

SUMMARY OF THE INVENTION

The present invention provides a field emission backlight unit which improves the luminous efficiency by improving the structure of electrodes formed on a lower substrate.

According to one aspect of the present invention, a field emission backlight unit is provided including: an upper substrate and a lower substrate separated from each other and facing each other; an anode arranged on a bottom surface of the upper substrate; a phosphor layer arranged on a bottom surface of the anode; a plurality of cathodes and a plurality of gate electrodes alternately arranged on a top surface of the lower substrate; and emitters formed on the plurality of cathodes; the plurality of gate electrodes include first gate electrodes of a conductive material arranged on the top surface of the lower substrate and second gate electrodes having a greater thickness than that of the first gate electrodes and arranged on a top surface of the first gate electrodes.

The first gate electrodes preferably include a thin film having a thickness in a range of 1000-3000 Å, and the second gate electrodes preferably include a thick film having a thickness in a range of 0.3-50 μm. The second gate electrodes preferably include a conductive material. The second gate electrodes preferably include a conductive paste including needle-like particles. The first and second gate electrodes preferably include a unitary body. The second gate electrodes preferably include a nonconductive material. The second gate electrodes preferably include a nonconductive paste including needle-like particles. The emitters are preferably arranged at both edges of the plurality of cathodes. The emitters preferably include carbon nanotubes (CNTs).

The field emission backlight unit preferably further includes a plurality of spacers arranged between the upper substrate and the lower substrate to maintain a uniform spacing therebetween.

According to another aspect of the present invention, a field emission backlight unit is provided including: an upper substrate and a lower substrate separated from each other and facing each other; an anode arranged on a bottom surface of the upper substrate; a phosphor layer arranged on a bottom surface of the anode; a plurality of cathodes and a plurality of gate electrodes alternately arranged on a top surface of the lower substrate; and emitters arranged on the plurality of cathodes; the gate electrodes include first gate electrodes including a conductive material on the top surface of the lower substrate and second gate electrodes having a greater thickness than that of the first gate electrodes and arranged on a top surface of the first gate electrodes; and the plurality of cathodes include first cathodes including a conductive material and arranged on the top surface of the lower substrate and second cathodes having a greater thickness than that of the first cathodes and arranged on a top surface of the first cathodes.

The first gate electrodes and the first cathodes preferably include a thin film having a thickness in a range of 1000-3000 Å, and the second gate electrodes and the second cathodes preferably include a thick film having a thickness in a range of 0.3-50 μm. The second gate electrodes preferably include a conductive material. The second gate electrodes preferably include a conductive paste including needle-like particles. The first and second gate electrodes preferably include a unitary body. The second gate electrodes preferably include a nonconductive material. The second gate electrodes preferably include a nonconductive paste including needle-like particles. The second cathodes preferably include a conductive material. The second cathodes preferably include a conductive paste including needle-like particles. The first and second cathodes preferably include a unitary body. The second cathodes preferably include a nonconductive material. The second cathodes preferably include a nonconductive paste including needle-like particles. The emitters are preferably arranged at both edges of the first cathodes. The emitters preferably include carbon nanotubes (CNTs).

The field emission backlight unit preferably further includes a plurality of spacers arranged between the upper substrate and the lower substrate to maintain a uniform spacing therebetween.

According to still another aspect of the present invention, a field emission backlight unit is provided including: an upper substrate and a lower substrate separated apart from each other and facing each other; an anode arranged on a bottom surface of the upper substrate; a phosphor layer arranged on a bottom surface of the anode; a plurality of cathodes and a plurality of gate electrodes alternately arranged on a top surface of the lower substrate; and emitters arranged on the plurality of cathodes; the cathodes include first cathodes including a conductive material and arranged on the top surface of the lower substrate and second cathodes having a greater thickness than that of the first cathodes and arranged on a top surface of the first cathodes.

The first cathodes preferably include a thin film having a thickness in a range of 1000-3000 Å, and the second cathodes preferably include a thick film having a thickness in a range of 0.3-50 μm. The second cathodes preferably include a conductive material. The second cathodes preferably include a conductive paste including needle-like particles. The first and second cathodes preferably include a unitary body. The second cathodes preferably include a nonconductive material. The second cathodes preferably include a nonconductive paste including needle-like particles. The emitters are preferably arranged at both edges of the first cathodes. The emitters preferably include carbon nanotubes (CNTs).

The field emission backlight unit preferably further includes a plurality of spacers arranged between the upper substrate and the lower substrate to maintain a uniform spacing therebetween.

BRIEF DESCRIPTION OF THE DRAWINGS

A more complete appreciation of the present invention and many of the attendant advantages thereof, will be readily apparent as the present invention becomes better understood by reference to the following detailed description when considered in conjunction with the accompanying drawings in which like reference symbols indicate the same or similar components, wherein.

DETAILED DESCRIPTION OF THE INVENTION

Figure 1:
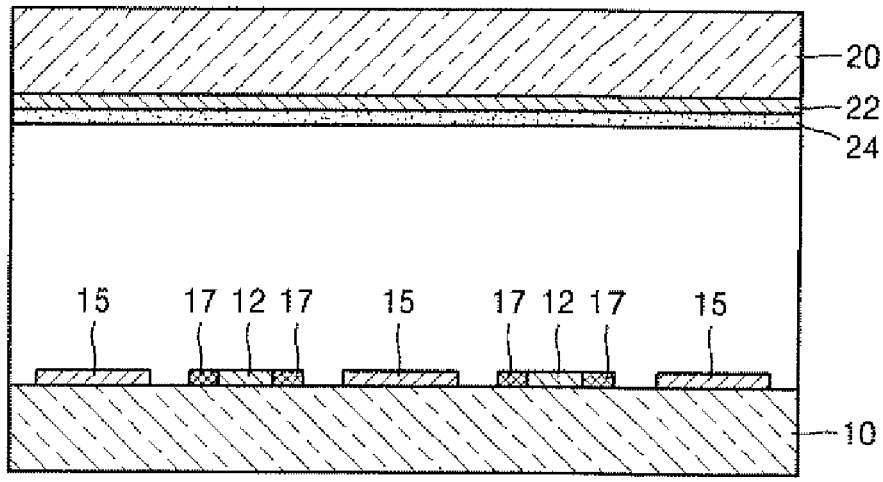
FIG. 1 (PRIOR ART)
FIG. 1 is a schematic cross-sectional view of a field emission backlight unit.
Figure 2:
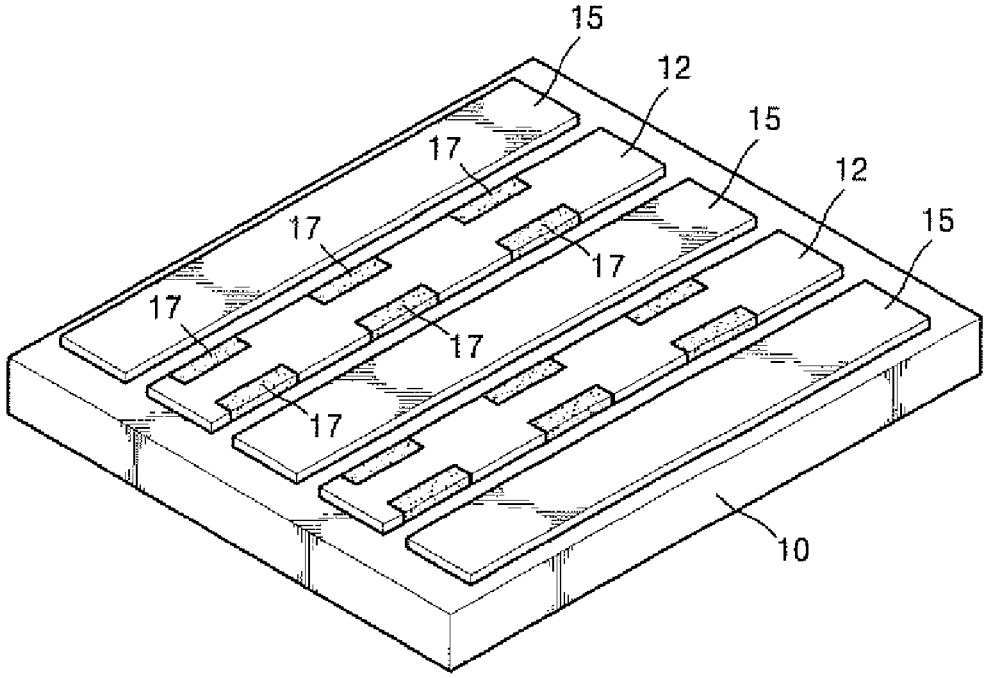
FIG. 2 (PRIOR ART)
FIG. 2 is a perspective view of a lower substrate on which cathodes and gate electrodes are formed, in the field emission backlight unit of FIG. 1.

FIG. 1 is a schematic cross-sectional view of a field emission backlight unit, and FIG. 2 is a perspective view of a lower substrate on which cathodes and gate electrodes are formed.

Referring to FIGS. 1 and 2, an upper substrate 20 and a lower substrate 10 are separated from each other and face each other. An anode 22 is formed on a bottom surface of the upper substrate 20, and a phosphor layer 24 is formed on a bottom surface of the anode 22. A plurality of cathodes 12 and a plurality of gate electrodes 15 which are arranged in parallel to one another are formed on a top surface of the lower substrate 10. The cathodes 12 and the gate electrodes 15 are alternately formed on the same plane. The cathodes 12 and the gate electrodes 15 are formed of a thin film having a thickness of about 1000-3000 Å. A plurality of emitters 17 formed of an electron emission material, for example, carbon nanotubes (CNTs), are disposed at both edges of the cathodes 12. Although not shown, a plurality of spacers for maintaining a uniform spacing between the upper substrate 20 and the lower substrate 10 are disposed therebetween. In the above structure, as voltages are supplied between the cathodes 12 and the gate electrodes 15, electrons are emitted from the emitters 17 disposed on the cathodes 12, and the emitted electrons are accelerated by the voltage supplied to the anode 22 and excite the phosphor layer 24 so that visible light is emitted.

However, in such a field emission backlight unit, since the cathodes 12 and the gate electrodes 15 are formed of a thin film on the same plane, an electric field formed around the emitters 17 formed on the cathodes 12 is greatly affected by the voltages supplied to the anode 22 as well as the voltages supplied to the gate electrodes 15. Thus, in order to maximize the luminous efficiency of the phosphor layer 24, if a high voltage is supplied to the anode 22, the electric field formed around the emitters 17 is affected by the voltage supplied to the anode 22 so that excessive electrons are emitted from the emitters 17. As such, the current that flows through the anode 22 increases. This results in degradation of the luminous efficiency of the backlight unit.

Figure 3:
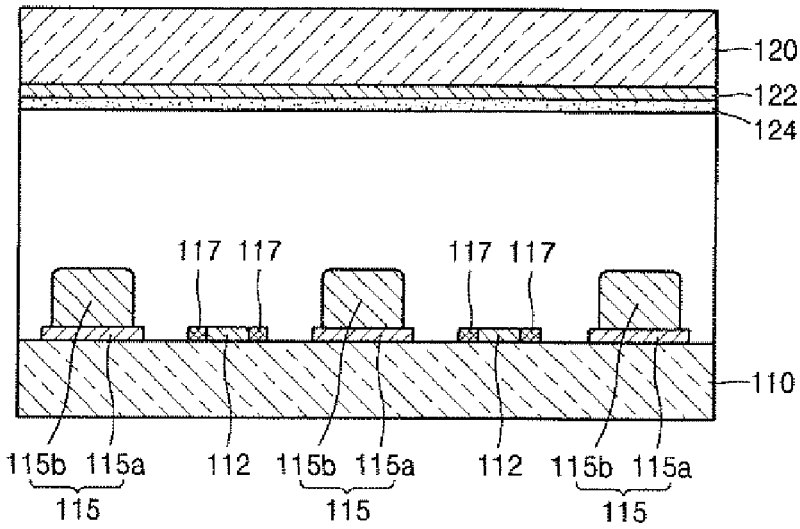
FIG. 3 is a schematic cross-sectional view of a field emission backlight unit according to an embodiment of the present invention.
Figure 4:
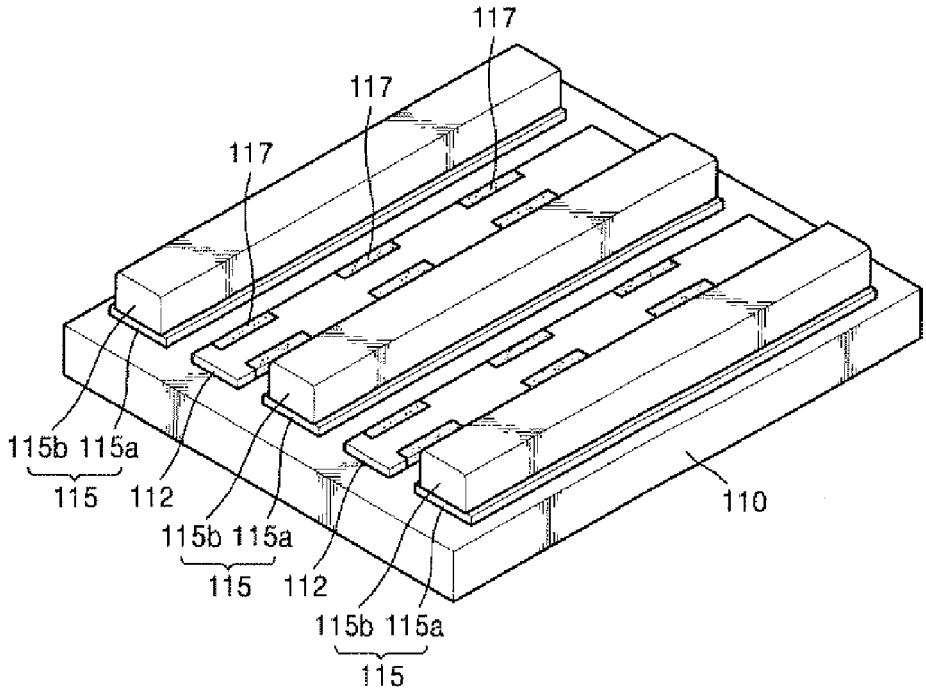
FIG. 4 is a perspective view of a lower substrate on which cathodes and gate electrodes are formed, in the field emission backlight unit of FIG. 3.

FIG. 3 is a schematic cross-sectional view of a field emission backlight unit according to an embodiment of the present invention, and FIG. 4 is a perspective view of a lower substrate on which cathodes and gate electrodes are formed, in the field emission backlight unit shown in FIG. 3.

Referring to FIGS. 3 and 4, an upper substrate 120 and a lower substrate 110 are separated from each other and face each other. A glass substrate is generally used as the upper substrate 120 and the lower substrate 110. An anode 122 is formed on a bottom surface of the upper substrate 120, and a phosphor layer 124 is formed on a bottom surface of the anode 122. The anode 122 can be formed of a transparent conductive material, for example, Indium Tin Oxide (ITO), so that visible light emitted from the phosphor layer 124 is transmitted through the material. The anode 122 can be formed of a thin film on the entire bottom surface of the upper substrate 120 or in a predetermined pattern, for example, in a stripe pattern, on the bottom surface of the upper substrate 120. The phosphor layer 124 can be formed by coating phosphor materials respectively producing red (R), green (G), and blue (B) light in predetermined patterns, on the bottom surface of the anode 122 or by coating a mixture of the phosphor materials producing R, G, and B light on the entire bottom surface of the upper substrate 120.

A plurality of cathodes 112 and gate electrodes 115 are alternately formed on a top surface of the lower substrate 110. In this case, the cathodes 112 and the gate electrodes 115 can be formed in a predetermined pattern, for example, in a stripe pattern. The cathodes 112 are formed of a thin film having a thickness of about 1000-3000 Å on the top surface of the lower substrate 110. The cathodes 112 are formed of a conductive material, for example, silver (Ag).

The gate electrodes 115 include first gate electrodes 115*a* formed on the top surface of the lower substrate 110 and second gate electrodes 115*b* having a greater thickness than that of the first gate electrodes 115*a* and are formed on the top surface of the first gate electrodes 115*a*. Specifically, the first gate electrodes 115*a* are formed of a thin film having a thickness of about 1000-3000 Å, and the second gate electrodes 115*b* are formed of a thick film having a thickness of about 0.3-50 μm. The first gate electrodes 115*a* can be formed by depositing a conductive material such as Ag on the top surface of the lower substrate 110. The second gate electrodes 115*b* can be formed of a conductive material or nonconductive material. The second gate electrodes 115*b* are formed of a thick film having a greater thickness of about 0.3-50 μm so that an electric field formed around the emitters 117 using voltages supplied to the cathodes 112 and the gate electrodes 115 is not affected by a voltage supplied to the anode 122. The second gate electrodes 115*b* can be formed of conductive paste such as an Ag paste, or a nonconductive paste. The conductive paste or nonconductive paste can be formed of needle-like particles so as to have a higher aspect ratio even after a baking process. The second gate electrodes 115*b* can be formed by coating the conductive paste or nonconductive paste on the top surface of the first gate electrodes 115*a* using a screen printing, spin coating, or slurry method. When the first and second gate electrodes 115*a* and 115*b* are formed of a conductive material, they can be formed as a unitary body.

A plurality of emitters 117 that emit electrons using voltages supplied between the cathodes 112 and the gate electrodes 115 are formed at both edges of the cathodes 112. The emitters 117 are formed of an electron emission material, such as carbon nanotubes (CNTs). When the emitters 117 are formed of CNTs, electron emission can be performed even at a low driving voltage. The emitters 117 can be formed in various shapes along the both edges of the cathodes 112, besides the shape of FIG. 4. Although not shown, a plurality of spacers for maintaining a uniform spacing between the upper substrate 120 and the lower substrate 110 are disposed therebetween.

In the field emission backlight unit having the above structure, the second gate electrodes 115*b* formed of a thick film on the top surface of the first gate electrodes 115*a* shield the electric field formed around the emitters 117 using the voltage supplied to the anode 122. As such, the electric field formed around the emitters 117 using the voltages supplied between the cathodes 112 and the gate electrodes 115 is not affected by the voltage supplied to the anode 122. Thus, in the field emission backlight unit of FIG. 3, current that flows through the anode 122 due to the voltage supplied to the anode 122 is reduced as compared to other field emission backlight units such that luminous efficiency can be improved.

Currents generated by the voltages supplied to the anode in the field emission backlight unit of FIGS. 1 and 2 and the field emission backlight unit according to the present invention of FIGS. 3 and 4 is compared using a simulation experiment. First, in the field emission backlight unit of FIGS. 1 and 2, when voltages supplied to the anode were 8 kV and 10 kV, respectively, currents that flow through the anode were 1.53 mA and 2.40 mA, respectively. Next, in the field emission backlight having the second gate electrodes 115*b* having a thickness of 20 μm according to the present invention, when voltages supplied to the anode 122 were 8 kV and 10 kV, respectively, currents that flow through the anode 122 were 1.18 mA and 1.71 mA, respectively. In the field emission backlight having the second gate electrodes 115*b* having a thickness of 50 μm according to the present invention, when voltages supplied to the anode 122 were 8 kV and 10 kV, respectively, currents that flow through the anode 122 were 0.80 mA and 1.05 mA, respectively. It could be understood through the above results that, in the field emission backlight unit according to the present invention, currents that flow through the anode 122 are reduced as compared to the conventional field emission backlight unit and as the thickness of the second gate electrodes 115*b* increases, currents that flow through the anode 122 are reduced.

Figure 5:
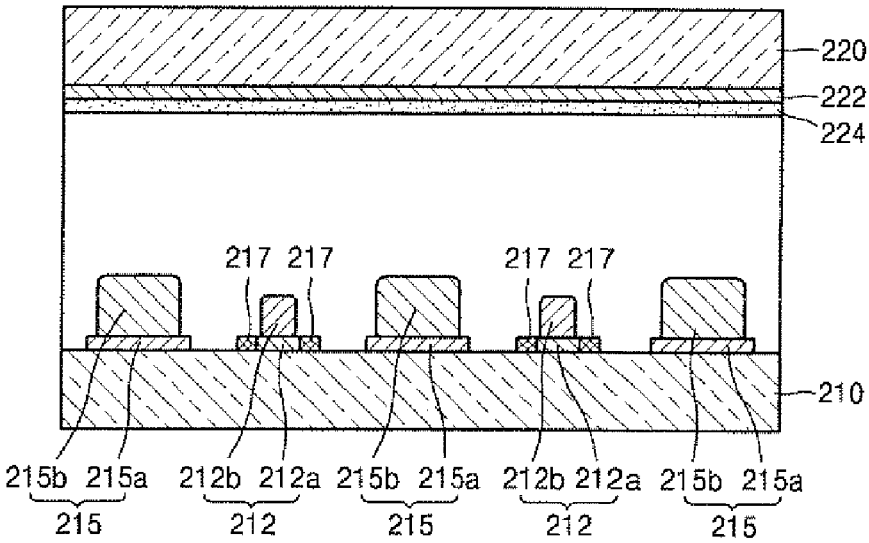
FIG. 5 is a schematic cross-sectional view of a field emission backlight unit according to another embodiment of the present invention.

FIG. 5 is a schematic cross-sectional view of a field emission backlight unit according to another embodiment of the present invention. Only differences between the field emission backlight unit of FIG. 5 and the field emission backlight unit of FIG. 3 are described.

Referring to FIG. 5, an upper substrate 220 and a lower substrate 210 are separated from each other and face each other. An anode 222 is formed on a bottom surface of the upper substrate 220, and a phosphor layer 224 is formed on a bottom surface of the anode 222.

A plurality of cathodes 212 and gate electrodes 215 are alternately formed on a top surface of the lower substrate 210. The gate electrodes 215 include first gate electrodes 215*a* formed of a conductive material on the top surface of the lower substrate 210 and second gate electrodes 215*b* having a larger thickness than the first gate electrodes 215*a* and formed on the top surface of the first gate electrodes 215*a*. Specifically, the first gate electrodes 215*a* are formed of a thin film having a thickness of about 1000-3000 Å, and the second gate electrodes 215*b* are formed of a thick film having a thickness of about 0.3-50 μm. The second gate electrodes 215*b* can be formed of a conductive material or a nonconductive material. The second gate electrodes 215*b* are formed of a thick film having a greater thickness so that an electric field formed around emitters 217 using voltages supplied to the cathodes 212 and the gate electrodes 215 is not affected by a voltage supplied to the anode 222. The second gate electrodes 215*b* can be formed of a conductive paste or a nonconductive paste formed of needle-like particles. When the first and second gate electrodes 215*a* and 215*b* are formed of a conductive material, they can be formed as a unitary body.

The cathodes 212 include first cathodes 212*a* formed of a conductive material on the top surface of the lower substrate 210 and second cathodes 212*b* having a greater thickness than that of the first cathodes 212*a* and are formed on the top surface of the first cathodes 212*a*. Specifically, the first cathodes 212*a* are formed of a thin film having a thickness of about 1000-3000 Å, and the second cathodes 212*b* are formed of a thick film having a thickness of about 0.3-50 μm. The second cathodes 212*b* can be formed of a conductive material or a nonconductive material. The second cathodes 212*b* are formed of a thick film having a large thickness so that an electric field formed around emitters 217 together with the second gate electrodes 215*b* is not affected by a voltage supplied to the anode 222. The second cathodes 212*b* can be formed of a conductive paste or a nonconductive paste formed of needle-like particles. When the first and second cathodes 212*a* and 212*b* are formed of a conductive material, they can be formed as a unitary body.

A plurality of emitters 217 that emit electrons using voltages supplied between the cathodes 212 and the gate electrodes 215 are formed at both edges of the first cathodes 212*a*. The emitters 217 are formed of an electron emission material, such as carbon nanotubes (CNTs). Although not shown, a plurality of spacers for maintaining a uniform spacing between the upper substrate 220 and the lower substrate 210 are disposed therebetween.

In the field emission backlight unit having the above structure, because of the existence of the second gate electrodes 215*b* formed of a thick film on the top surface of the first gate electrodes 215*a* and the second cathodes 212*b* formed of a thick film on the top surface of the first cathodes 212*a*, an electric field formed around the emitters 217 using the voltages between the cathodes 212 and the gate electrodes 215 is not affected by the voltage supplied to the anode 222.

Figure 6:
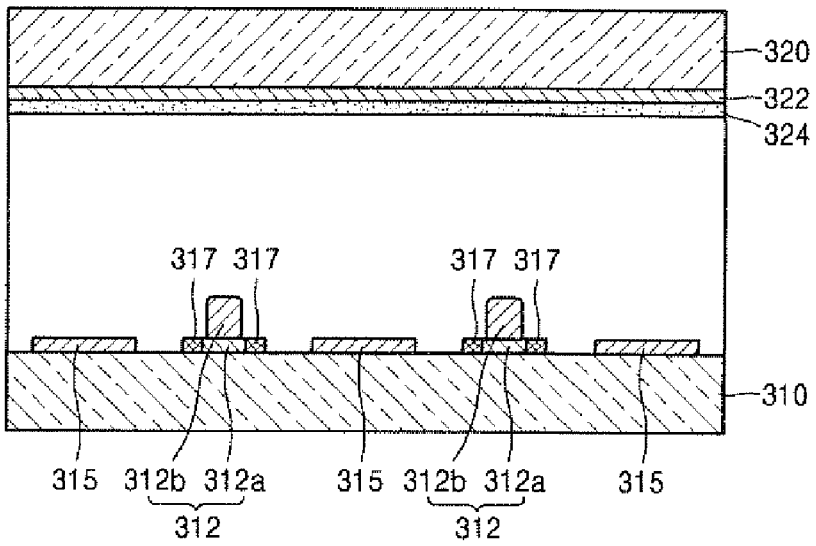
FIG. 6 is a schematic cross-sectional view of a field emission backlight unit according to another embodiment of the present invention.

FIG. 6 is a schematic cross-sectional view of a field emission backlight unit according to another embodiment of the present invention. Only differences between the field emission backlight unit of FIG. 6 and the field emission backlight units of FIGS. 3 and 5 are described.

Referring to FIG. 6, an upper substrate 320 and a lower substrate 310 are separated from each other and face each other. An anode 322 is formed on a bottom surface of the upper substrate 320, and a phosphor layer 324 is formed on a bottom surface of the anode 322.

A plurality of cathodes 312 and gate electrodes 315 are alternately formed on a top surface of the lower substrate 310. The cathodes 312 include first cathodes 312*a* formed of a conductive material on the top surface of the lower substrate 310 and second cathodes 312*b* having a greater thickness than that of the first cathodes 312*a* and formed on the top surface of the first cathodes 312*a*. Specifically, the first cathodes 312*a* are formed of a thin film having a thickness of about 1000-3000 Å, and the second cathodes 312*b* are formed of a thick film having a thickness of about 0.3-50 μm. The second cathodes 312*b* can be formed of a conductive material or a nonconductive material. The second cathodes 312*b* are formed of a thick film having a large thickness so that an electric field formed around emitters 317 is not affected by a voltage supplied to the anode 322. The second cathodes 312*b* can be formed of a conductive paste or a nonconductive paste formed of needle-like particles. When the first and second cathodes 312*a* and 312*b* are formed of a conductive material, they can be formed as a unitary body.

The gate electrodes 315 are formed of a thin film having a thickness of about 1000-3000 Å on the top surface of the lower substrate 310. The gate electrodes 315 are formed of a conductive material.

A plurality of emitters 317 that emit electrons using voltages supplied between the cathodes 312 and the gate electrodes 315 are formed at both edges of the first cathodes 312*a*. The emitters 317 are formed of an electron emission material, such as carbon nanotubes (CNTs). Although not shown, a plurality of spacers for maintaining a uniform spacing between the upper substrate 320 and the lower substrate 310 are disposed therebetween.

In the field emission backlight unit having the above structure, because of the existence of the second cathodes 312*b* formed of a thick film on the top surface of the first cathodes 312*a*, an electric field formed around the emitters 317 using the voltages supplied between the cathodes 312 and the gate electrodes 315 is not affected by the voltage supplied to the anode 322.

As described above, in the field emission backlight unit according to the present invention, second gate electrodes are formed of a thick film on the top surface of first gate electrodes formed of a thin film or second cathodes are formed of a thick film on the top surface of first cathodes formed of a thin film such that an electric field formed around emitters is not affected by a voltage supplied to an anode. As such, in the field emission backlight unit according to the present invention, currents that flow through the anode are reduced as compared to that of other field emission backlight units and luminous efficiency can be improved.

While the present invention has been particularly shown and described with reference to exemplary embodiments thereof, it will be understood by those of ordinary skill in the art that various modifications in form and detail can be made therein without departing from the spirit and scope of the present invention as defined by the following claims.

What is claimed is:

1. A field emission type backlight unit comprising:

upper substrate and lower substrate separated by a predetermined distance from each other and facing each other;

an anode formed on a bottom surface of the upper substrate;

a phosphor layer formed on a bottom surface of the anode;

a plurality of cathodes and gate electrodes alternately formed on a top surface of the lower substrate; and emitters formed on the cathodes, wherein the gate electrodes include first gate electrodes formed of a conductive material on the top surface of the lower substrate and second gate electrodes having a larger thickness than the first gate electrodes and formed on a top surface of the first gate electrodes.

2. The field emission type backlight unit of claim 1, wherein the first gate electrodes are formed of a thin film having a thickness of 1000-3000 Å, and the second gate electrodes are formed of a thick film having a thickness of 0.3-50 μm.

3. The field emission type backlight unit of claim 1, wherein the second gate electrodes are formed of a conductive material.

4. The field emission type backlight unit of claim 3, wherein the second gate electrodes are formed of conductive paste formed of needle-like particles.

5. The field emission type backlight unit of claim 3, wherein the first and second gate electrodes are formed as a single body.

6. The field emission type backlight unit of claim 1, wherein the second gate electrodes are formed of a nonconductive material.

7. The field emission type backlight unit of claim 6, wherein the second gate electrodes are formed of nonconductive paste formed of needle-like particles.

8. The field emission type backlight unit of claim 1, wherein the emitters are formed at both edges of the cathodes.

9. The field emission type backlight unit of claim 1, wherein the emitters are formed of carbon nanotubes (CNTs).

10. The field emission type backlight unit of claim 1, further comprising a plurality of spacers disposed between the upper substrate and the lower substrate to maintain a uniform interval therebetween.

11. A field emission type backlight unit comprising:

upper substrate and lower substrate separated by a predetermined distance from each other and facing each other;

an anode formed on a bottom surface of the upper substrate;

a phosphor layer formed on a bottom surface of the anode;

a plurality of cathodes and gate electrodes alternately formed on a top surface of the lower substrate; and emitters formed on the cathodes, wherein the gate electrodes include first gate electrodes formed of a conductive material on the top surface of the lower substrate and second gate electrodes having a larger thickness than the first gate electrodes and formed on a top surface of the first gate electrodes, and the cathodes include first cathodes formed of a conductive material on the top surface of the lower substrate and second cathodes having a larger thickness than the first cathodes and formed on a top surface of the first cathodes.

12. The field emission type backlight unit of claim 11, wherein the first gate electrodes and the first cathodes are formed of a thin film having a thickness of 1000-3000 Å, and the second gate electrodes and the second cathodes are formed of a thick film having a thickness of 0.3-50 μm.

13. The field emission type backlight unit of claim 11, wherein the second gate electrodes are formed of a conductive material.

14. The field emission type backlight unit of claim 13, wherein the second gate electrodes are formed of conductive paste formed of needle-like particles.

15. The field emission type backlight unit of claim 13, wherein the first and second gate electrodes are formed as a single body.

16. The field emission type backlight unit of claim 11, wherein the second gate electrodes are formed of a nonconductive material.

17. The field emission type backlight unit of claim 16, wherein the second gate electrodes are formed of nonconductive paste formed of needle-like particles.

18. The field emission type backlight unit of claim 11, wherein the second cathodes are formed of a conductive material.

19. The field emission type backlight unit of claim 18, wherein the second cathodes are formed of conductive paste formed of needle-like particles.

20. The field emission type backlight unit of claim 18, wherein the first and second cathodes are formed as a single body.

21. The field emission type backlight unit of claim 11, wherein the second cathodes are formed of a nonconductive material.

22. The field emission type backlight unit of claim 21, wherein the second cathodes are formed of nonconductive paste formed of needle-like particles.

23. The field emission type backlight unit of claim 11, wherein the emitters are formed at both edges of the first cathodes.

24. The field emission type backlight unit of claim 11, wherein the emitters are formed of carbon nanotubes (CNTs).

25. The field emission type backlight unit of claim 11, further comprising a plurality of spacers disposed between the upper substrate and the lower substrate to maintain a uniform interval therebetween.

26. A field emission type backlight unit comprising:

upper substrate and lower substrate separated by a predetermined distance from each other and facing each other;

an anode formed on a bottom surface of the upper substrate;

a phosphor layer formed on a bottom surface of the anode;

a plurality of cathodes and gate electrodes alternately formed on a top surface of the lower substrate; and emitters formed on the cathodes, wherein the cathodes include first cathodes formed of a conductive material on the top surface of the lower substrate and second cathodes having a larger thickness than the first cathodes and formed on a top surface of the first cathodes.

27. The field emission type backlight unit of claim 26, wherein the first cathodes are formed of a thin film having a thickness of 1000-3000 Å, and the second cathodes are formed of a thick film having a thickness of 0.3-50 μm.

28. The field emission type backlight unit of claim 26, wherein the second cathodes are formed of a conductive material.

29. The field emission type backlight unit of claim 28, wherein the second cathodes are formed of conductive paste formed of needle-like particles.

30. The field emission type backlight unit of claim 28, wherein the first and second cathodes are formed as a single body.

31. The field emission type backlight unit of claim 26, wherein the second cathodes are formed of a nonconductive material.

32. The field emission type backlight unit of claim 31, wherein the second cathodes are formed of nonconductive paste formed of needle-like particles.

33. The field emission type backlight unit of claim 26, wherein the emitters are formed at both edges of the first cathodes.

34. The field emission type backlight unit of claim 26, wherein the emitters are formed of carbon nanotubes (CNTs).

35. The field emission type backlight unit of claim 26, further comprising a plurality of spacers disposed between the upper substrate and the lower substrate to maintain a uniform interval therebetween.

* * * * *